US005313752A

United States Patent [19]

Hatzinikolas

[11] Patent Number: 5,313,752

[45] Date of Patent: May 24, 1994

[54] WALL FRAMING SYSTEM

[75] Inventor: Michael A. Hatzinikolas, Edmonton, Canada

[73] Assignee: Fero Holdings Limited, Edmonton, Canada

[21] Appl. No.: 817,508

[22] Filed: Jan. 7, 1992

[30] Foreign Application Priority Data

Jan. 11, 1991 [CA] Canada ..... 2034081

[51] Int. Cl.[5] ..... E04B 2/58

[52] U.S. Cl. ..... 52/243; 52/690

[58] Field of Search ..... 52/281, 573, 664, 690, 52/241, 243, 731.7, 731.8, 731.9, 721, 243, 690; 403/353, 354, 375

[56] References Cited

U.S. PATENT DOCUMENTS 2,056,328 10/1936 Price ..... 52/243
2,058,386 10/1936 Parsons .
2,235,761 3/1941 Goldsmith ..... 52/690
2,260,777 10/1941 Goldsmith ..... 52/721
2,275,109 3/1942 McGee .
2,321,671 6/1943 Grolta ..... 52/243
3,066,774 12/1962 Dahme .
3,717,964 2/1973 Brown et al. ..... 52/690

*Primary Examiner*—Carl D. Friedman
*Assistant Examiner*—Christopher Kent
*Attorney, Agent, or Firm*—Murray E. Thrift; Adrian D. Battison; Stanley G. Ade

[57] ABSTRACT

A wall framing system accommodates deflections and frame shortening in building structures to avoid applying structural loads to veneer walls. The system includes a ceiling rail and vertical studs connected to the rail with a vertical slip joint between each stud and the rail. The slip joint is formed with a connector plate integral with the ceiling rail web and vertical slots in the connector plate. The slots accommodate screws threaded into a stud.

12 Claims, 4 Drawing Sheets

WALL FRAMING SYSTEM

FIELD OF THE INVENTION

The present invention relates to the field of wall framing, and more particularly, to a veneer wall framing system.

BACKGROUND OF THE INVENTION

Deflection and frame shortening of building structures may be caused by creep, elastic deflections or thermal movement. These conditions, and others, cause a transfer of vertical loads to the framing systems of non-load bearing veneer walls. This is undesirable since the walls are not designed to carry such loads. At the same time, the wall framing system must carry the usual lateral loads.

The present invention is concerned with the provision of a novel wall framing system that accommodates these structural movements and with the mode of load transfer from the framing to the supporting element.

SUMMARY OF THE INVENTION

The present invention provides a wall framing system comprising:

(a) an elongate substantially horizontal rail having a connector plate projecting substantially vertically from one side thereof;

(b) a substantially vertical stud; and (c) connecting means connecting to the stud to the connector plate for free relative vertical movement of the stud and the rail.

The rail may be a ceiling or floor rail. Preferred framing systems have both floor and ceiling rails configured this way. Preferred connecting means includes slots in the connector plate and slide blocks slideable in the slots and connected to the stud. The frame system allows for vertical movement of the rail on the studs, so that vertical loading of the wall frame is eliminated.

According to another aspect of the present invention there is provided a rail for a wall framing system comprising an elongate web, a plurality of U-shaped slots formed in the web and spaced uniformly therealong so as to define a plurality of rectangular tabs joined to the web along transverse fold lines, and a plurality of elongate slots in each tab, perpendicular to the associated fold line.

BRIEF DESCRIPTION OF THE DRAWING

In drawings which illustrate a prior art framing system and an embodiment of the invention.

DETAILED DESCRIPTION

Figure 1:
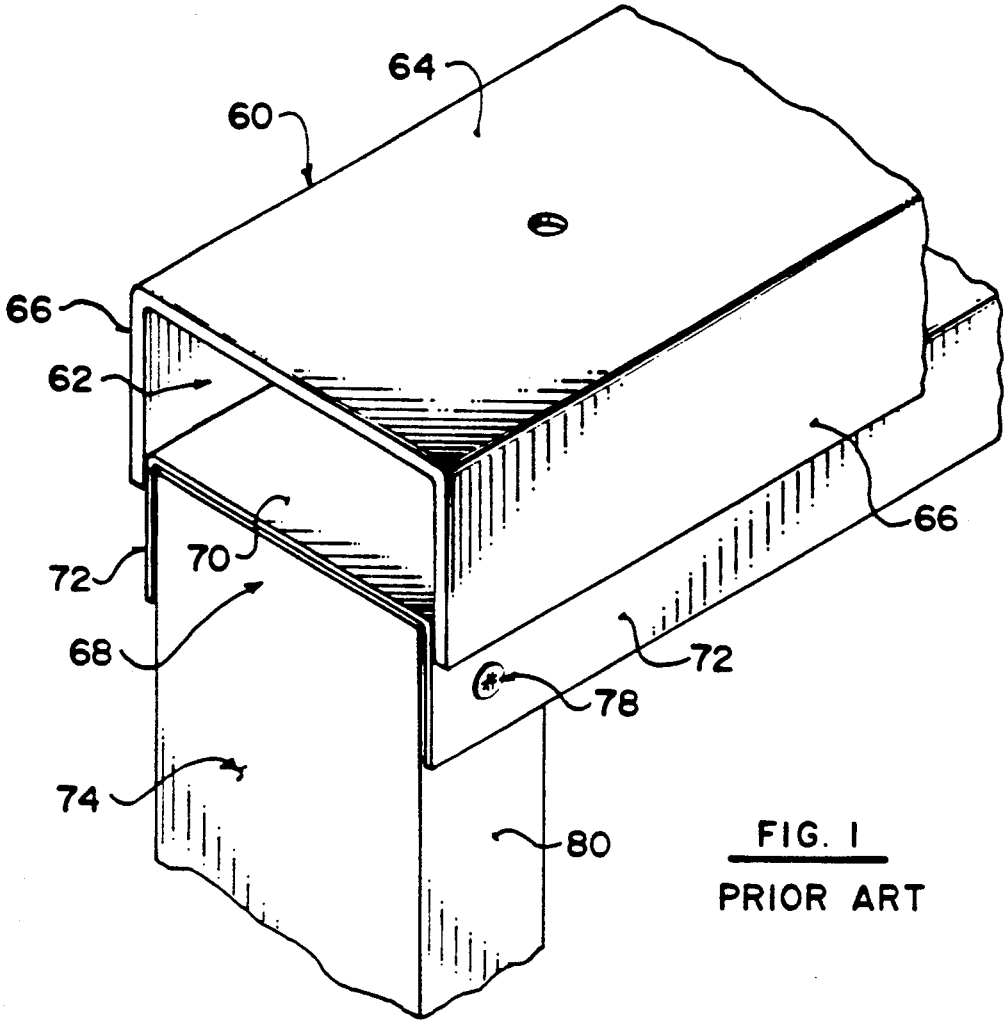
FIG. 1 PRIOR ART
FIG. 1 is an isometric view of a prior art wall system.
Figure 3:
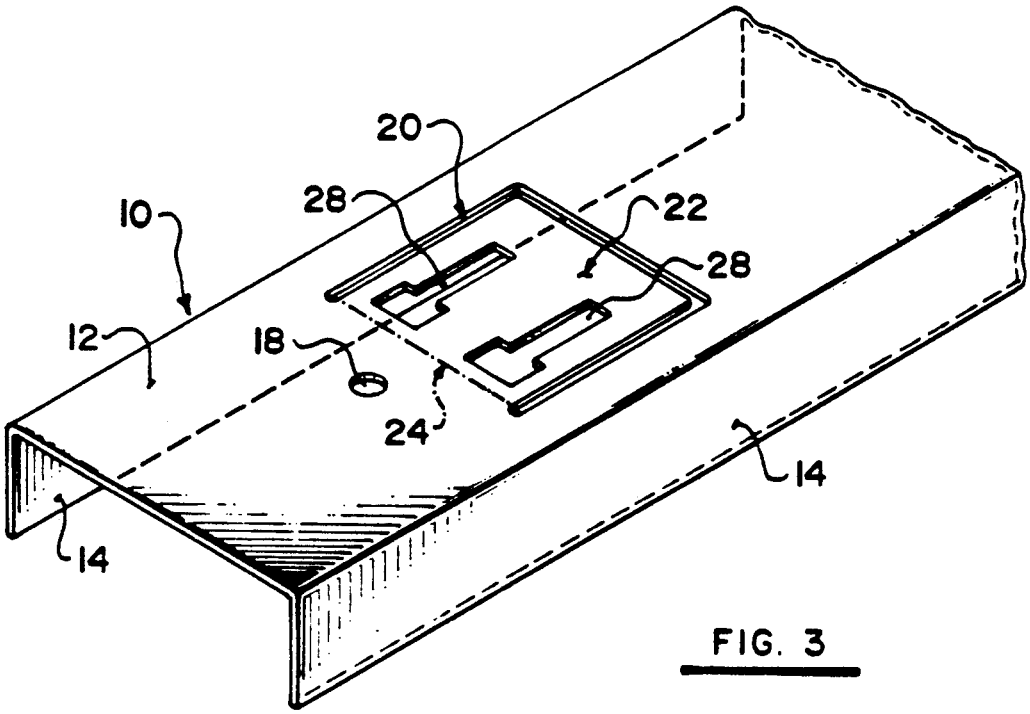
FIG. 3 is an isometric view of a veneer wall ceiling rail according to the present invention.
Figure 2:
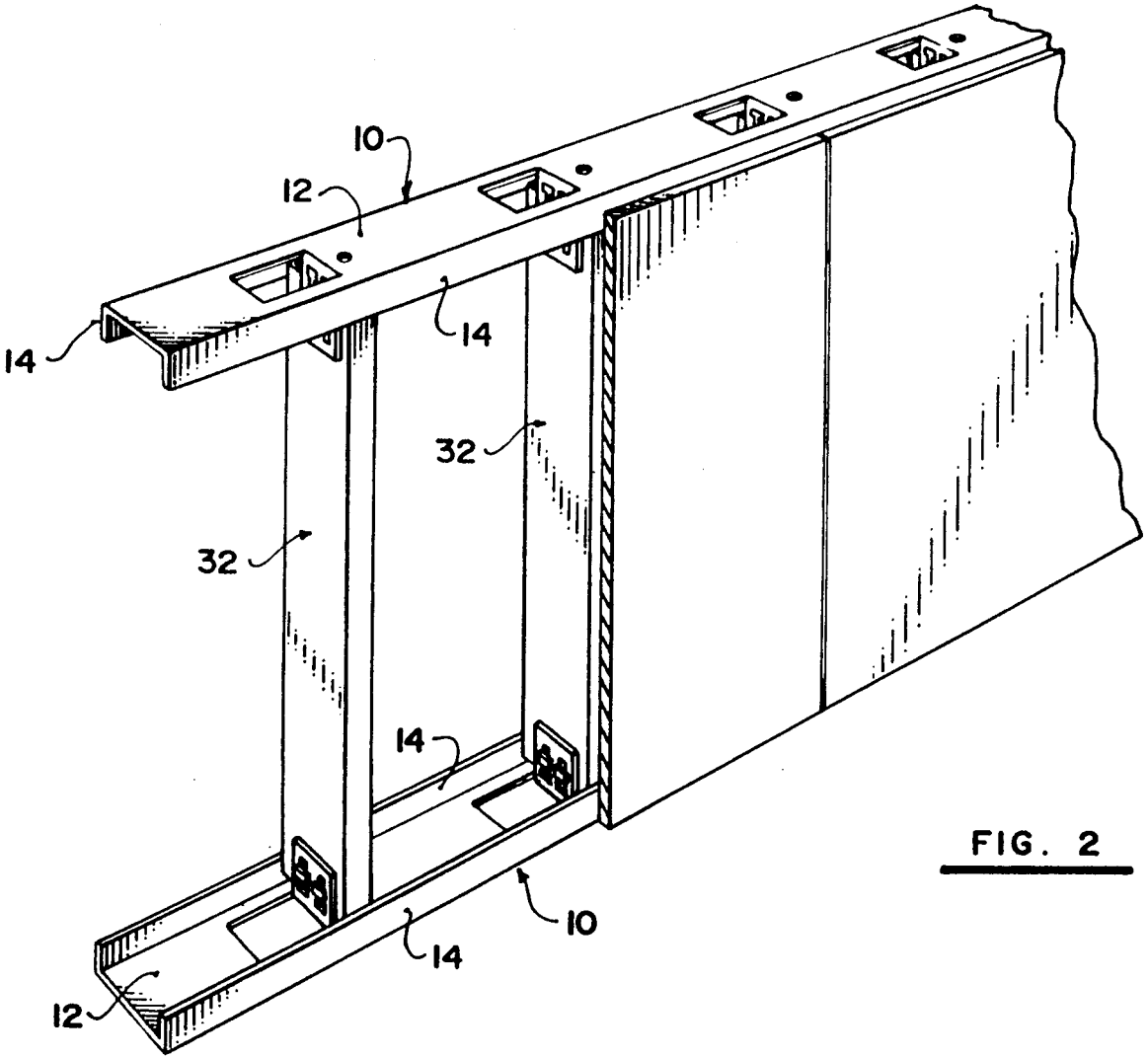
FIG. 2 is a perspective view of a wall frame system according to the present invention showing an attached veneer wall.
Figure 4:
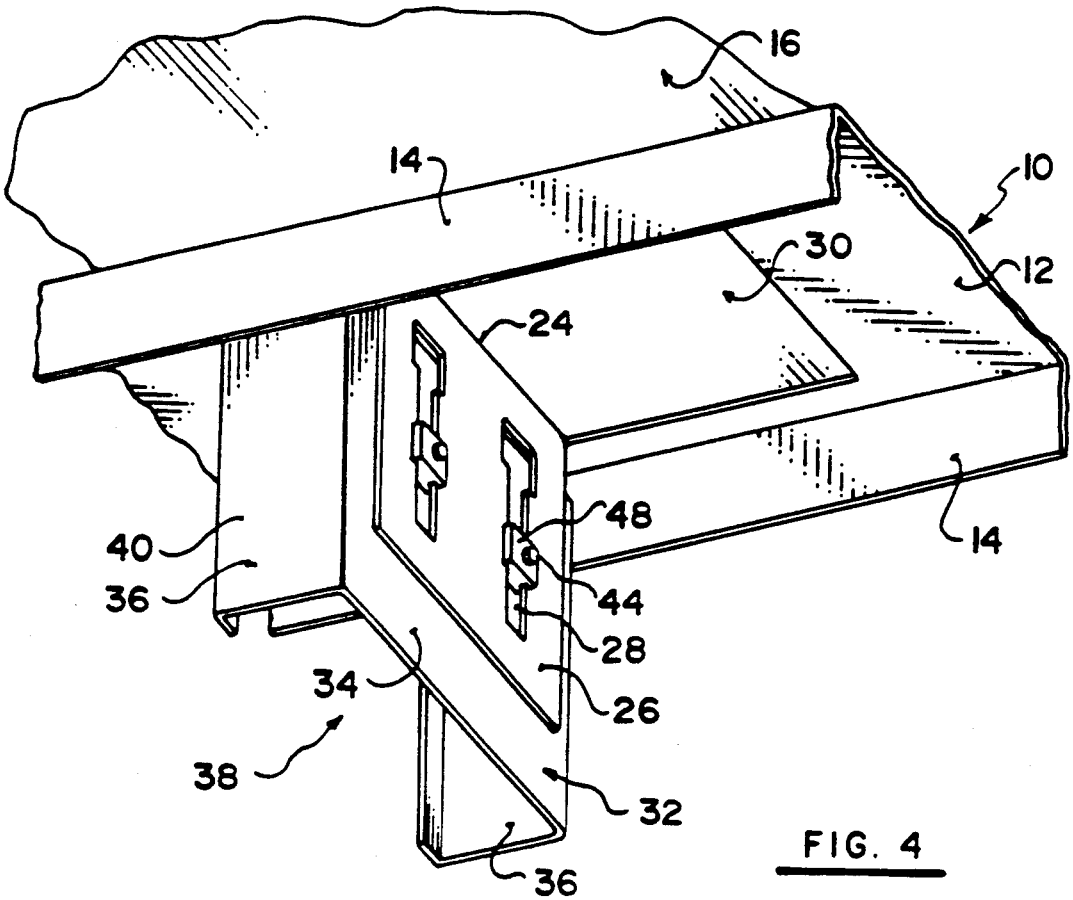
FIG. 4 is an isometric view illustrating the attachment of the ceiling rail to a stud.

The prior art framing system shown in FIG. 1, has a double channel ceiling rail 60. This includes a ceiling mounted channel 62 having a web 64 and two flanges 66.

The second channel 68 comprises a web 70 and two flanges 72. Channel 68 fits slideably into the channel 62, between the flanges 66 so that the two tracks will move vertically with respect to one another.

The end of a stud 74 fits into the second channel 68 and is attached to the second channel by means of screws 78 through the flanges 72 and side flanges 80 of the stud 74.

The prior art double channel system is susceptible to deflections of the first channel 64 which must be very thick to resist loads in bending. The system is also expensive.

Referring now to FIGS. 2 through 6, there is illustrated an exemplary embodiment of the present invention comprising a channel shaped ceiling rail 10, having a web 12 between two flanges 14. The ceiling rail is fastened by an appropriate means of attachment, for example nails (not illustrated) to a support 16 (FIG. 4) such as an overhead floor slab, through openings 18 in the web 12 to the ceiling rail 10.

The web 12 of the ceiling rail 10 has a series of U-shaped slots 20 spaced uniformly along the web at a conventional stud spacing, for example 16 inches. Each slot defines a rectangular tab 22, joined to the web along a transverse fold line 24 across the web 12. The tab 22 has two side by side T-shaped slots 28 within the length of the tab 22, parallel to the flanges 14.

For use, the tab 22 is bent 90° along the fold line 24 to form an integral vertical connector plate 26, extending perpendicularly from the web 12 and oriented perpendicularly to the flanges 14. Bending the tab 22 out of the web leaves a corresponding opening 30 in the web.

The fastener openings 18 in the web 12 are positioned adjacent the fold lines 24.

The vertical studs 32 are also channel shaped each including a web 34 and two flanges 36. At the outer edge of each flange 36, the flange is folded 90° inwardly so that the flange is L-shaped in profile. There is a gap 38 between the confronting edges of the flanges 36. The stud is dimensioned so that its end will fit into the channel 10 between the flanges 14.

Figure 6:
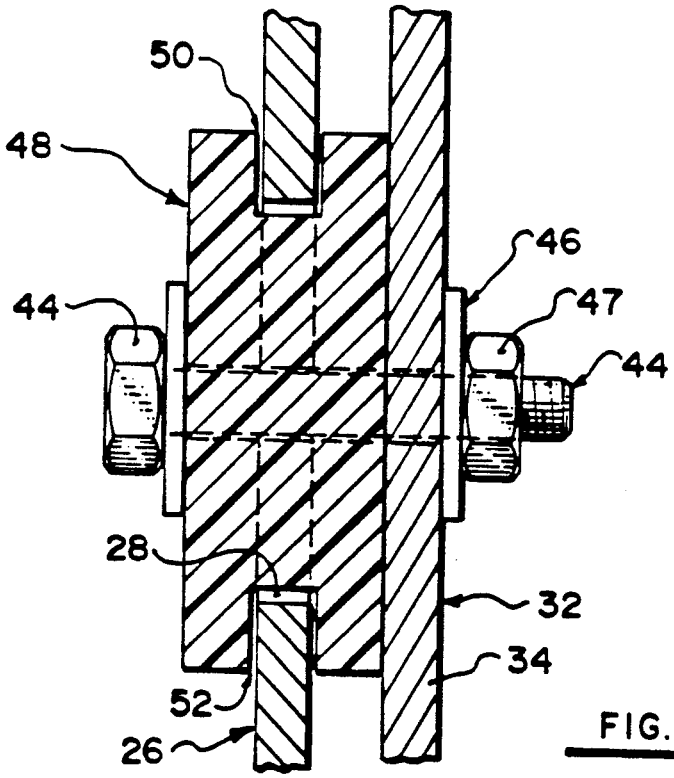
FIG. 6 is a cross-sectional view of a plastic insert engaging a slot in a connector plate.
Figure 5:
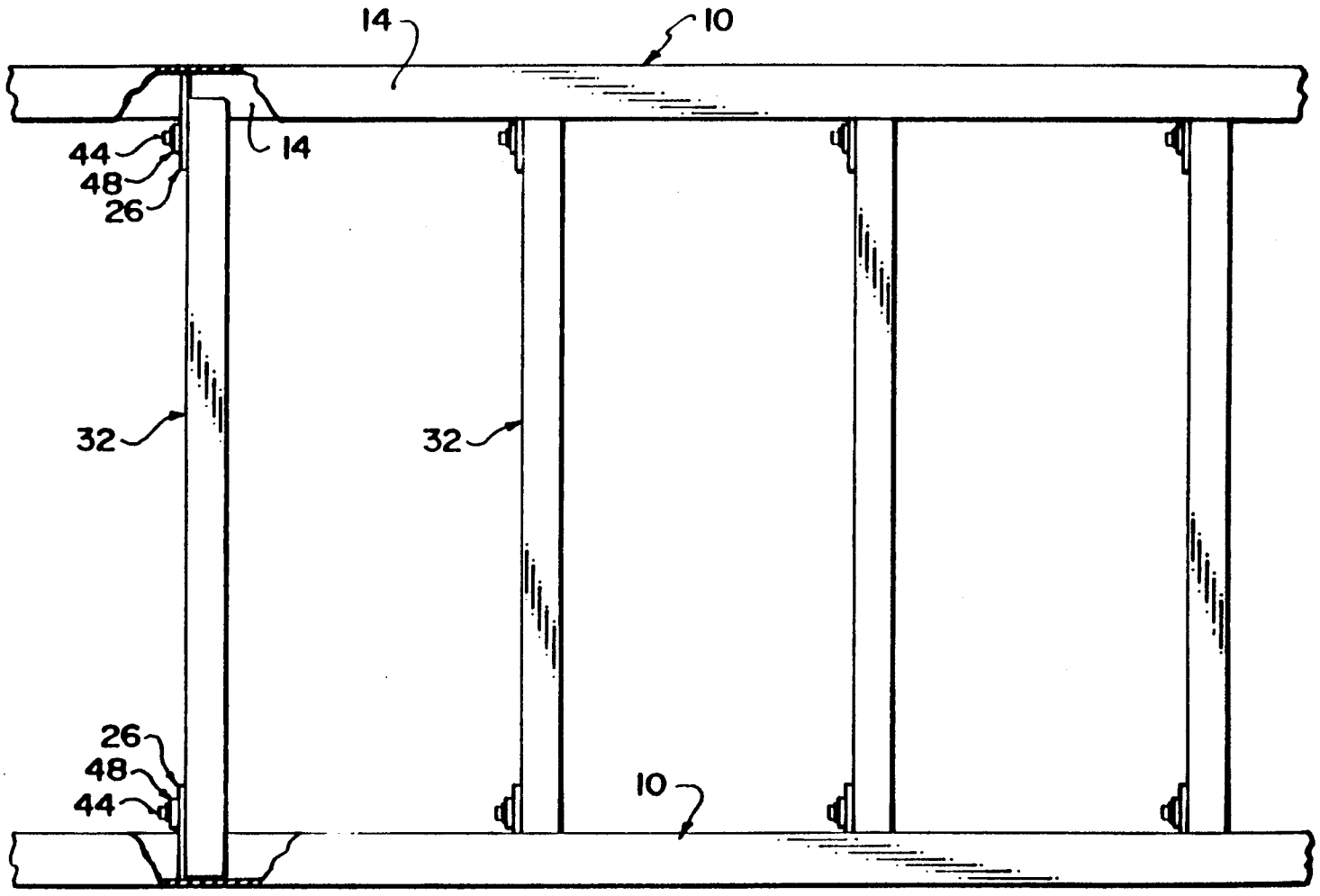
FIG. 5 is an elevation, partly broke away, of a wall frame constructed according to the present invention.

The web 34 of the stud is fastened to the connector plate 26 of the rail by two bolts 44 and respective plastic inserts 48 slideably engaged in the T-shaped slots 28. Each plastic insert 48 is "H" shaped when viewed in cross-section, as shown in FIG. 6, and may be installed by being placed within the enlarged end of the associated T-shaped slot so that the grooves 50 and 52 along the opposite sides of the insert are aligned with the edges of the narrow portion of the T-shaped slot 28. The insert is then positioned in the narrow portion of the T-shaped slot 28. The bolts 44 pass through the respective inserts and fasten the inserts to the stud 32 using washers 46 and nuts 47.

The slots 28 accommodate relative vertical movements that may be produced by the deflection of the ceiling rail, causing frame shortening. As the frame experiences vertical movement, the connector plate 26 moves along the stud 32 as the inserts 48 attching the connector plate 26 and the stud 32 moves along the slots 28 of the connector plate 26.

The fastener openings 18 for mounting the rail are located adjacent the respective fold lines 24, so that vertical forces acting on the rail will act at adjacent points, thus minimizing bending movements.

The floor rail is of the same configuration as the ceiling rail. It is connected to the studs in the same way so as to provide additional accommodation for deflections.

The present invention is not limited to the embodiment disclosed and the right is reserved to make variations and modifications in the invention that do not depart from the spirit and scope thereof as herein defined by the appended claims.

I claim:

1. A wall between a floor and a ceiling, comprising:

floor and ceiling rails adapted to be secured to the floor and ceiling respectively, at least one of the rails having a plurality of connector plates projecting substantially vertically therefrom and a plurality of substantially vertical slots in each connector plate;

a plurality of substantially vertical studs;

coupling means coupling the studs to the rails, the coupling means including slip joint means coupling the studs to the connector plates for relative vertical movement of the studs on the connector plates, the slip joint means comprising a plurality of insert members, each insert member engaging slidably in a respective one of the slots in the connecting plates and extending between the associated connecting plate and stud and thereby spacing the stud from the connecting plate, and fastener means connecting each insert member to the stud; and wall panels secured to the studs;

whereby relative vertical movements of the rails are accommodated by the slip joints.

2. A wall according to claim 1 wherein said floor and ceiling rails have connector plates thereon.

3. A wall framing system comprising:

(a) an elongate, substantially horizontal rail having a connector plate projecting substantially vertically from one side thereof and a plurality of substantially vertical slots in the connector plate;

(b) a substantially vertical stud;

(c) a plurality of insert members, each insert member engaging slidably in a respective one of the slots in the connector plate and extending between the connecting plate and the stud thereby spacing the stud from the connector plate; and (d) fastener means connecting each insert member to the stud.

4. A wall framing system according to claim 3 in which the rail is channel shaped and comprises a web and two spaced apart, parallel flanges.

5. A wall framing system according to claim 3 in which the connector plate is integral with the rail.

6. A wall framing system according to claim 3 including a plurality of connector plates projecting from the one side of the rail.

7. A wall framing system according to claim 3, wherein each insert member has grooves therein slideably engaging the respective side edges of a respective one of the slots in the connecting plate.

8. A wall framing system according to claim 3 in which the fastener means comprises a bolt.

9. A wall framing system according to claim 3 in which the stud comprises a channel.

10. A wall framing system according to claim 3, wherein the rail comprises an elongate web, a plurality of U-shaped slots formed in the web and spaced uniformly therealong so as to define a plurality of rectangular connector plates joined to the web along transverse fold lines, the vertical slots comprising a plurality of elongate T-shaped slots in each tab, perpendicular to the associated fold line.

11. A wall framing system according to claim 10 including a plurality of fastener openings in the web adjacent respective ones of the fold lines.

12. A wall framing system according to claim 10 wherein the rail comprises two flanges extending along opposite sides of the web such that the rail has a channel-shaped profile.

* * * * *